US005263871A

United States Patent [19]

Sano

[11] Patent Number: 5,263,871

[45] Date of Patent: Nov. 23, 1993

[54] DEVICE FOR INTERCONNECTING CONNECTORS

[75] Inventor: Yukiharu Sano, Shizuoka, Japan

[73] Assignee: Yazaki Corporation, Tokyo, Japan

[21] Appl. No.: 933,699

[22] Filed: Aug. 24, 1992

[30] Foreign Application Priority Data

Aug. 27, 1991 [JP] Japan ..... 3-215350

[51] Int. Cl.[5] ..... H01R 13/62

[52] U.S. Cl. ..... 439/157; 439/549; 439/372

[58] Field of Search ..... 439/372, 152-160, 439/346, 347, 259, 262, 549

[56] References Cited

U.S. PATENT DOCUMENTS

| | | | |
|---|---|---|---|
| 4,332,432 | 6/1982 | Colleran | 439/347 |
| 4,840,574 | 6/1989 | Mills | 439/372 |
| 5,135,410 | 8/1992 | Kawase et al. | 439/372 |

FOREIGN PATENT DOCUMENTS

| | | | |
|---|---|---|---|
| 3812097 | 10/1989 | Fed. Rep. of Germany | 439/347 |
| 1-142345 | 9/1989 | Japan . | |
| 0056876 | 2/1990 | Japan | 439/372 |
| 453456 | 6/1968 | Switzerland | 439/372 |

*Primary Examiner*—David L. Pirlot

*Attorney, Agent, or Firm*—Sughrue, Mion, Zinn, Macpeak & Seas

[57] ABSTRACT

A connecting device in which female and male connectors mounted respectively, for example, on a dashboard and an instrument panel are fitted and connected together simultaneously when the instrument panel is mounted on the dashboard, and a dimensional error in the connection between the female and male connectors is absorbed, thereby preventing damage to terminals and the housing. The male connector (A), holding a plurality of female terminals (16), is attached to the dashboard (a) or the instrument panel (d), and the female connector (B), holding a plurality of male terminals (21), is attached to the other. The male connector is movable toward and away from the female connector utilizing a connector holder (D). Retaining grooves (5) and flexible retaining arms (9) are respectively provided in the male connector (A) and the holder for retaining the male connector in a provisionally-fitted position where the female and male terminals are out of contact with each other when the two members (a) and (d) are assembled together. A cam member (C) is provided for moving the male connector from the provisionally-fitted position to a completely-fitted position where the female and male terminals are completely contacted with each other. In alternative embodiments, the female connector is moveable instead of, or in addition to, the male connector.

15 Claims, 12 Drawing Sheets

DEVICE FOR INTERCONNECTING CONNECTORS

BACKGROUND OF THE INVENTION

1. Field of the Invention

This invention relates to a connecting device for fittingly connecting female and male connectors together, for example, when automatically mounting component parts of an automobile.

2. Background

Recently, the automatic mounting of various component parts of an automobile has been strongly promoted. For example, it has now been required that the connection of a wire harness be performed simultaneously with the mounting of an instrument panel on a dashboard. FIG. 12 shows one example of a conventional arrangement as disclosed in Japanese Laid-Open Utility Model Application No. 1-42345. Mounting guides b are provided on a central portion of a dashboard a, and engagement e rails for engaging the guides are provided on an instrument panel d. Simultaneously with the mounting of the instrument panel d on the dashboard a, connectors c on the right and left sides of the dashboard are respectively connected to connectors c' on the instrument panel. As shown in FIG. 13, the connector c' is in the form of a movable connector having an annular springs f provided on four sides thereof such that the connector is moveable in the horizontal and vertical directions to compensate for mounting error. The connector is supported in fitting groove h provided in one of connector mounting plates g.

With such a construction, dimensional error in the direction of fitting of the connectors cannot be sufficiently accommodated. Further, due to the inertia produced when mounting a relatively heavy instrument panel d, the two connectors c and c' are shifted from an initially-fitted condition to a completely-fitted condition with their orientations unchanged. Therefore, when the number of poles of the connector terminals is large, or when the force of insertion of the terminals is large, a large force is exerted on the connectors, resulting in a problem that the terminals and the connector housing are likely to be damaged. Therefore, the electrical connection cannot be reliably achieved.

SUMMARY OF THE INVENTION

With the above problems in view, it is an object of this invention to provide a connecting device in which, where one of female and male connectors is provided on a mounting member such as a dashboard and the other is provided on an attachment member such as an instrument panel, dimensional error associated with the connection between the female and male connectors when the mounting member and the attachment members are assembled together is positively absorbed in order to prevent connector terminals and connector housings from being damaged, thereby achieving a highly-reliable electrical connection.

The above object has been achieved by a connecting device wherein a male connector holding a plurality of female terminals is attached to one of a mounting member and an attachment member which is adapted to be mounted on the mounting member in opposed relation thereto; a female connector holding a plurality of male terminals is attached to the other of the two members; and the male connector is fitted in a hood of the female connector simultaneously when the two members are assembled together, thereby connecting the female and male terminals together. The connecting device is characterized in that at least one of the female and male connectors is movable toward and away from the other. Further, there is provided means for holding the movable connector in a provisionally-fitted position where the female and male terminals are out of contact with each other when the two members are assembled together and means for moving the movable connector from the provisionally-fitted position to a completely-fitted position when the female and male terminals are completely contacted with each other.

When the mounting member and the attachment member are assembled together, the female and male connectors do not shift from an initially-fitted condition directly to the completely-fitted condition in contrast with the prior art, and the connectors are held in the provisionally-fitted position where the female and male terminals are out of contact with each other. Due to this provisional fitting, the misalignment due to a dimensional error in the connection between the female and male connectors is accommodated, and the mating female and male terminals are aligned with each other, thus providing the properly-aligned condition. Therefore, an undue force will not be exerted on the female and male terminals (connector terminals) and the connector housing, and damage thereto is prevented. The movement from the provisionally-fitted position to the completely-fitted position is achieved, for example, by the use of a cam member utilizing leverage. By doing so, this movement can be easily accomplished with a smaller force even with respect to the connectors of the multi-pole type.

DESCRIPTION OF THE PREFERRED EMBODIMENTS

Figure 1:
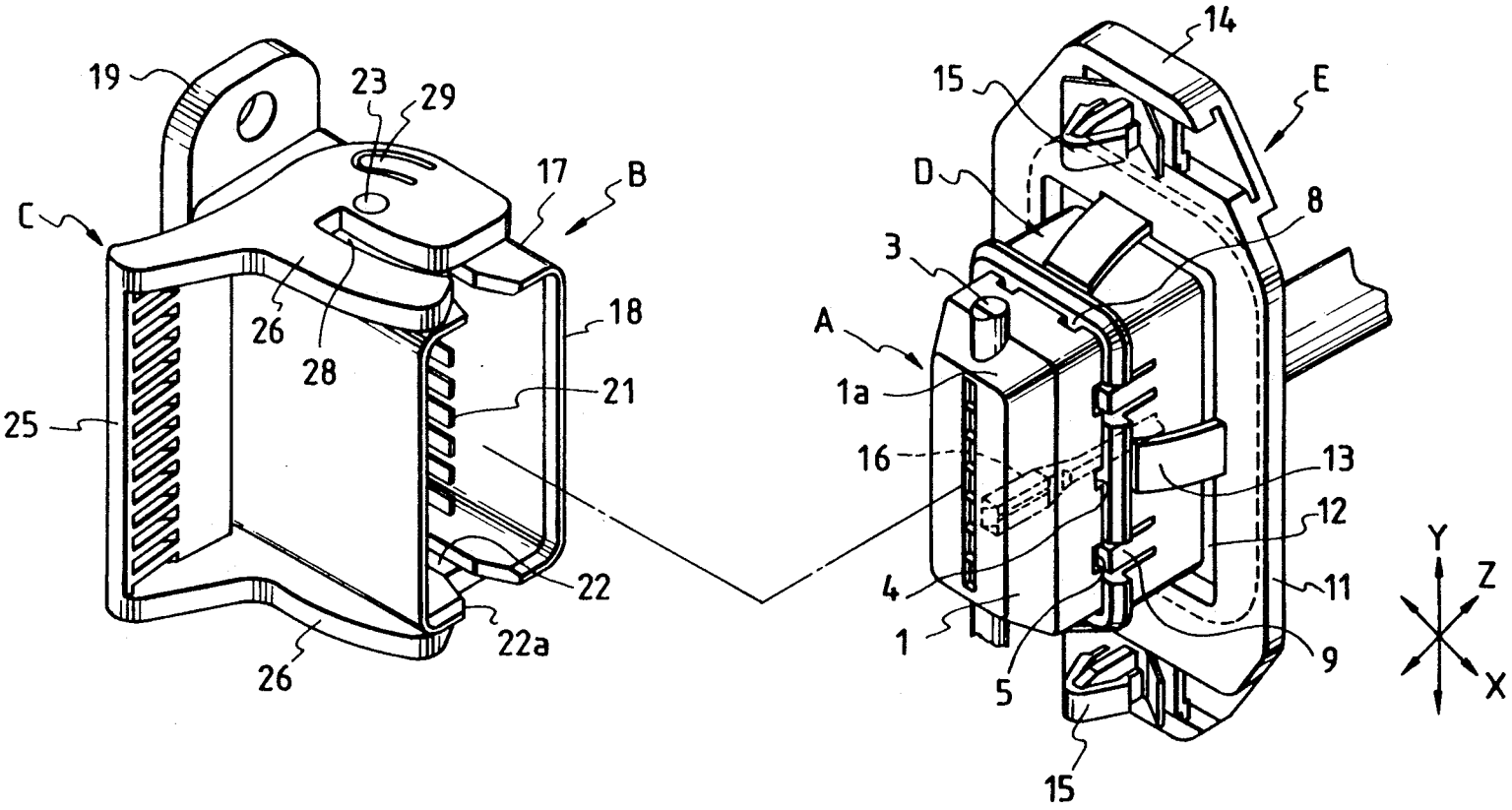
FIG. 1 is a perspective view of a first embodiment of a device of the present invention, showing male and female connectors in their separated condition.

FIGS. 1 to 5 show a first embodiment of the present invention. In FIG. 1, reference characters A, B and D respectively denote a male connector, a female connector and a cam member. The male connector A is supported on a dashboard through a connector holder D and a bracket E. The female connector B is fixedly mounted on an instrument panel body. In the first embodiment, the male connector A is movable back and forth in the direction of fitting, and is so supported as to be resiliently displaceable in the vertical and horizontal directions. As discussed below, the male connector A is moved toward the female connector B by the angular movement of the cam member C.

Figure 2:
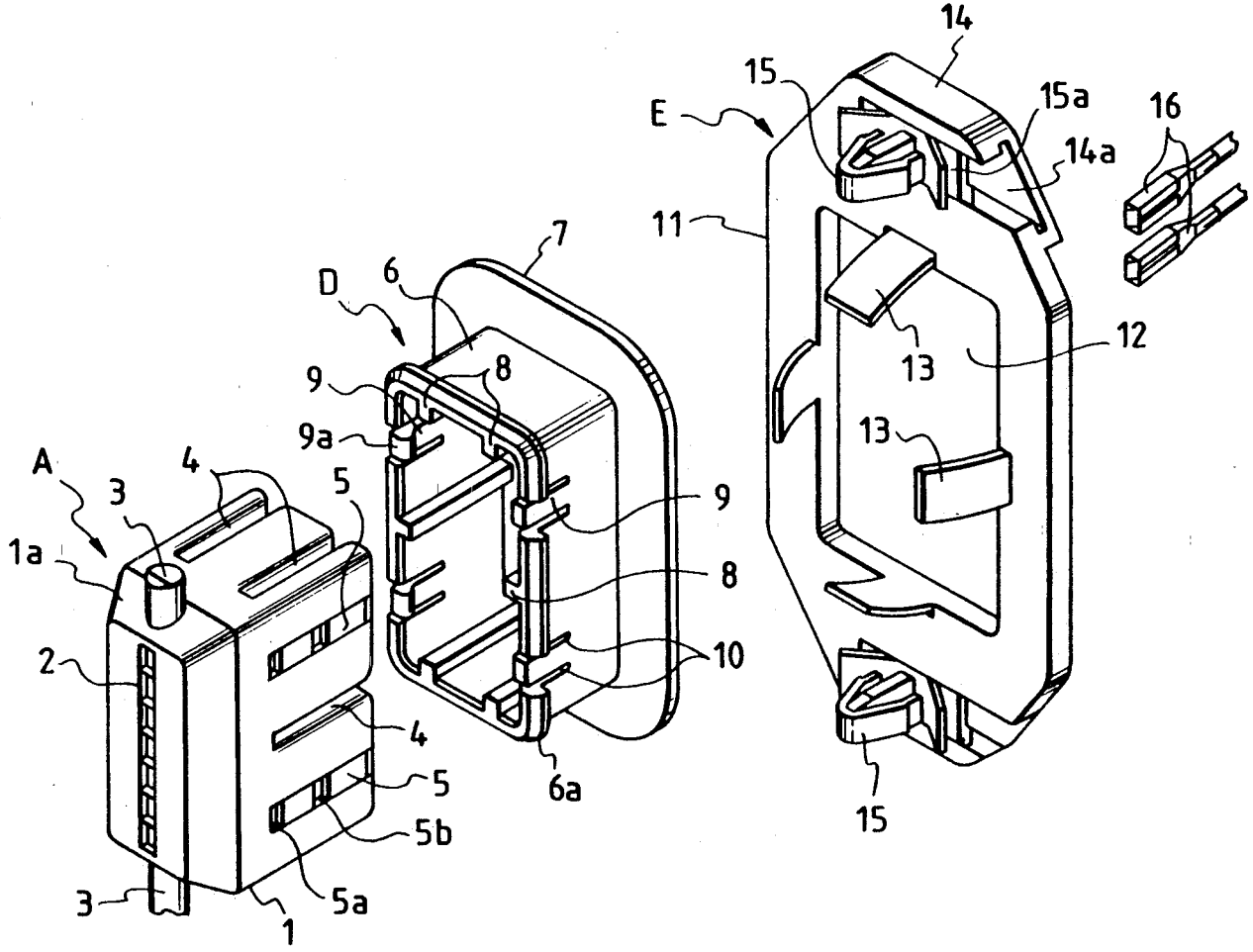
FIG. 2 is an exploded perspective view of the male connector of FIG. 1.

FIG. 2 illustrates the interconnection of the male connector A, connector holder D and bracket E. As shown in FIG. 2, a synthetic resin housing 1 of the male connector A has a plurality of terminal receiving chambers 2 therein, and cam pins 3 are formed respectively on upper and lower portions of the outer peripheral wall of this housing. A female terminal 16 with a wire attached thereto is adapted to be received in the terminal receiving chamber 2. To facilitate the insertion of the male housing A into the female housing B, a chamfered surface 1*a* is formed on that surface of the housing 1 to be fitted in the female connector B. A plurality of guide grooves 4 for guiding the connector holder D are formed in the outer peripheral wall of the housing 1, the guide grooves 4 extending in the fitting direction. The male connector A further includes two (upper and lower) slide grooves 5 and 5 formed in the side walls of the housing, and a provisionally-retaining recess 5*a* and a completely-retaining recess 5*b* formed in each of the slide grooves 5. The function of these grooves is described below.

The connector holder D comprises a frame-like body 6 for movably supporting the male connector A, and a withdrawal prevention flange 7 formed on a rear peripheral edge of the body 6. Elongate guide projections 8, for fitting in the respective guide grooves 4 of the male connector A, are formed on the inner surfaces of each of the upper, lower and side walls of the frame-like body 6, and two (upper and lower) flexible retaining arms 9 are provided on each of the side walls of the frame-like body 6. Each of the flexible retaining arms 9 is resiliently displaceable inwardly of the frame-like body 6 due to the slits 10 provided respectively on the opposite sides of the retaining arm 9. A retaining pawl 9*a* is formed on the free end of the retaining arm 9 for engagement with the provisionally-retaining recess 5*a* and the completely-retaining recess 5*b* in the slide groove 5. Finally, a reinforcement rib 6*a* is formed on the front peripheral edge of the frame-like body 6.

The bracket E includes a frame-like body 11 having a centrally disposed fitting hole 12 for receiving the connector holder D, and resilient support pieces 13 respectively formed on the four sides defining the hole 12. As a means for securing the bracket E to the dashboard, a clip mounting portion 14 having a dovetail-shaped groove 14*a* is formed on each of the opposite ends of the plate-like body 11 between which the fitting hole 12 is formed. A base plate portion 15*a* of a clip 15 is detachably connected to the dovetail groove 14*a*. Alternatively, the clip 15 may be molded of plastic integrally with the plate-like body 11.

Figure 3:
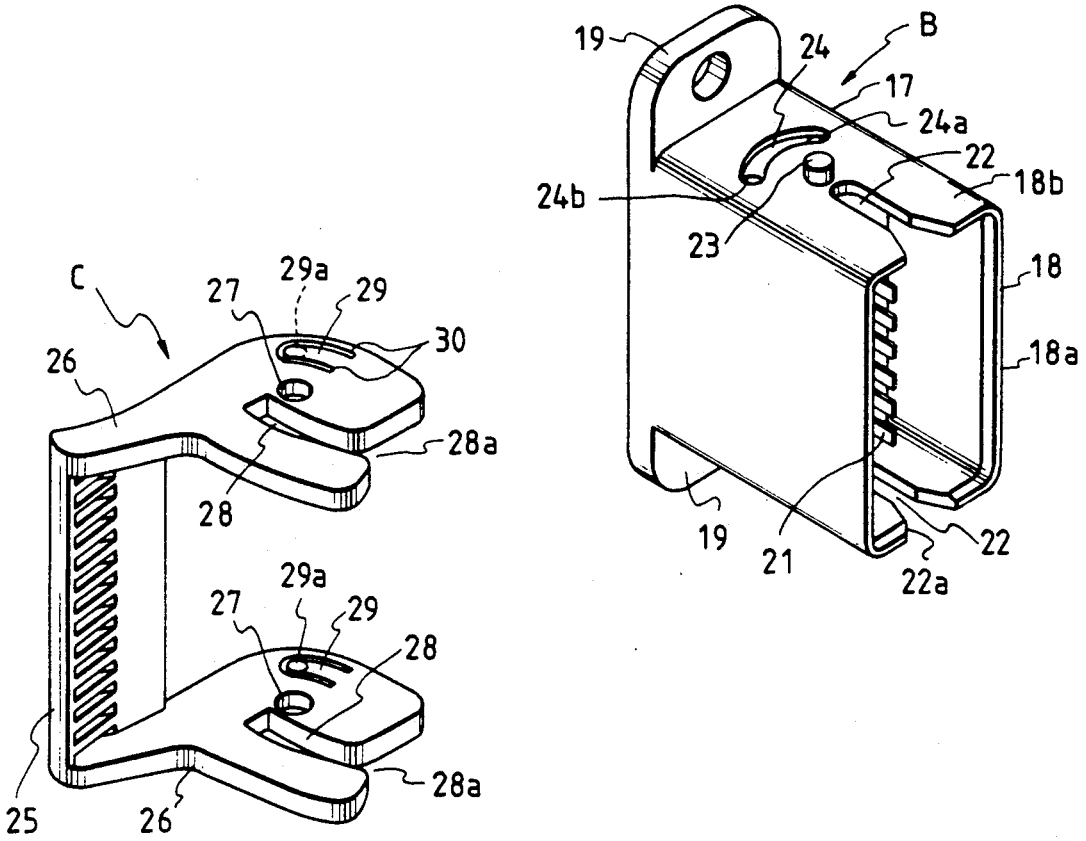
FIG. 3 is an exploded perspective view of the female connector of FIG. 1.

As shown in FIG. 3, the female connector B includes a housing body 17 having at its front portion a hood 18 for receiving the male connector A, and having a mounting flange 19 at its rear end portion. Male terminals 21, to be mated with the respective female terminals 16, are received and retained in terminal receiving chambers 20 (see FIG. 4) within the body 17. The hood 18 comprises a frame having right and left side walls 18*a* and upper and lower walls 18*b*. Pin guide grooves 22 for receiving the cam pins 3 of the male connector A are formed in the upper and lower walls 18*b*, respectively. The pin guide groove 22 extends in the direction of fitting of the male connector A, and have an open end constituting an introduction groove 22*a* having a width sufficiently larger than the outer diameter of the cam pin 3. Pins 23 for pivotally supporting the cam member C protrude from the upper and lower walls 18*b* of the hood 18, and are disposed adjacent the closed ends of the pin guide grooves 22. Disposed rearwardly of the pin 23 in each of the upper and lower walls 18*b* is formed an arcuate groove 24, with the pin 23 disposed at the radial center of the arcuate groove 24. A provisionally-retaining recess 24*a* is provided in one end (the right end in the drawings) of the groove 24, and a completely-retaining recess 24*b* is provided in the other end of the groove 24.

The cam member C is U-shaped and includes a pair of opposed levers 26, and an operating plate 25 interconnecting shoulder portions of the levers 26. Each lever 26 has a pivot hole 27 and a cam groove 28 which is disposed forwardly of the pivot hole 27 and which has an open end. The lever 26 also has a flexible retaining piece 29, disposed rearwardly of the pivot hole 27, which includes a retaining pawl 29*a* formed on the inner surface of the free end thereof. According to the invention, the cam pin 3 of the male connector A is engaged in the cam groove 28 of the cam member C and the retaining pawl of the flexible retaining piece 29 is engaged in the retaining groove 24 of the female connector B, and is resiliently displaceable due to the presence of the two slits 30.

In the above construction, when the connector holder D is inserted into the fitting hole 12 in the bracket E, the withdrawal prevention flange 7 abuts against the plate-like body and the distal ends of the resilient support pieces 13 engage the reinforcement rib 6*a*. Therefore, the connector holder D is secured so as to be prevented from moving back and forth in the insertion direction of the male and female connectors. Further, the connector holder D is supported by the resilient support pieces 13 at the four sides so as to be displaceable in the Vertical and horizontal directions, as indicated by arrows X and Y in FIG. 1. Then, the male connector A, attached to an end of a wire harness W, is inserted into the frame-like body 6 of the holder D to achieve a provisionally-retained condition. Namely, the guide projections 8 on the inner surface of the frame-like body 6 are fitted respectively in the guide grooves 4 in the outer periphery of the housing 1, so that the male connector A can be smoothly inserted. At this time, the retaining pawl 9*a* of each flexible retaining arm 9 slides along the slide groove 5, and is engaged in the provisionally-retaining recess 5*a*, so that the male connector A is provisionally retained on the connector holder D so as to move in directions indicated by arrow Z in FIG. 1. Finally, as shown in FIG. 4(A), the bracket E, to which the connector A is attached through the connector holder D, is fixedly secured, for example, to a dashboard a by inserting the clips 15 into mounting holes 1*a* in the dashboard, as shown in FIG. 4(*a*).

On the other hand, the female connector B is fixedly secured, for example, to an instrument panel d (see FIG. 11) by screws passing through the mounting flange 19. Initially, cam member C is pivotally secured to the female housing B as the pins 23 are received respectively in the pivot holes 27 in the levers 26, and the retaining pawl 29*a* of each flexible retaining piece 29 is engaged in the provisionally-retaining recess 24*a* in the retaining groove 24 to achieve a provisionally-retained condition (see FIG. 1). In this provisionally-retained condition, the open end 28*a* of the cam groove 28 is in registry with the introduction guide groove 22*a* of the pin guide groove 22.

Figure 4A:
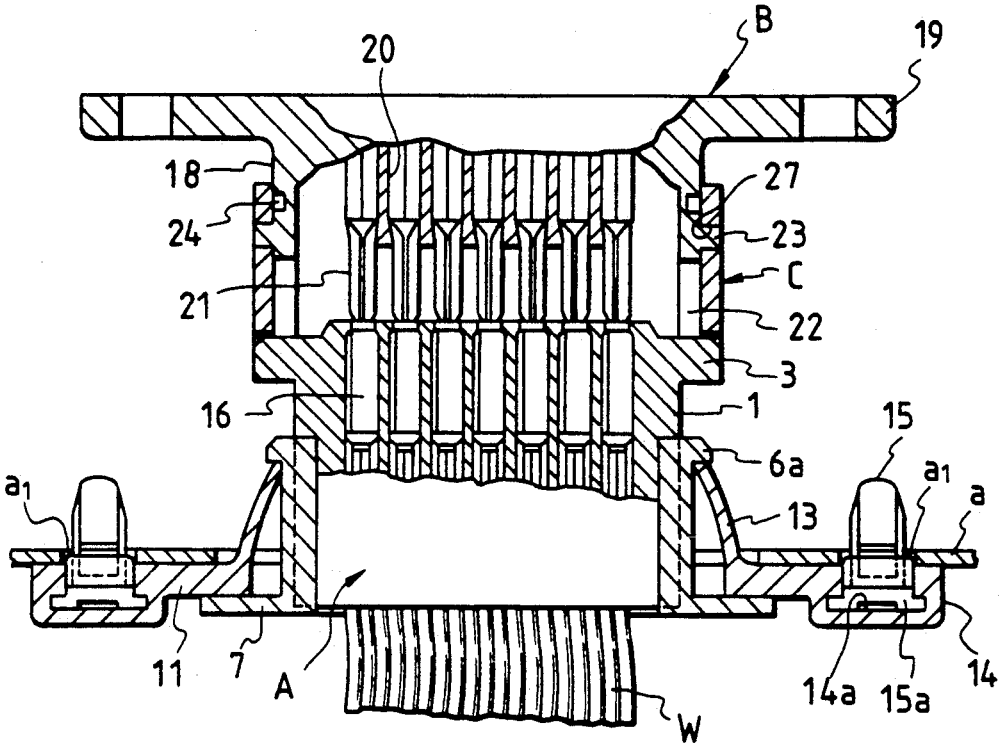
FIG. 4(A) is a cross-sectional view showing a provisionally-fitted condition of the female and male connectors of FIG. 1.
Figure 5A:
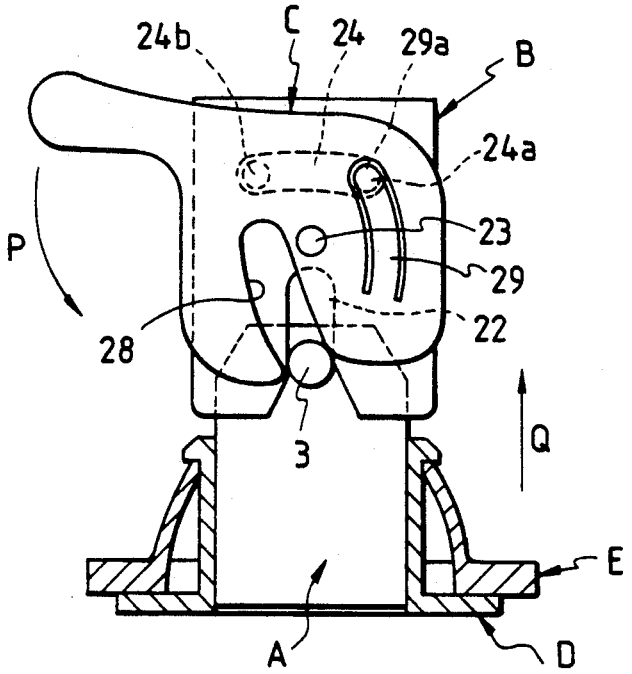
FIGS. 5(A) and 5(B) are partial cross-sectional, side-elevational views showing the connection arrangement of FIGS. 4(A) and 4(B), respectively.
Figure 11:
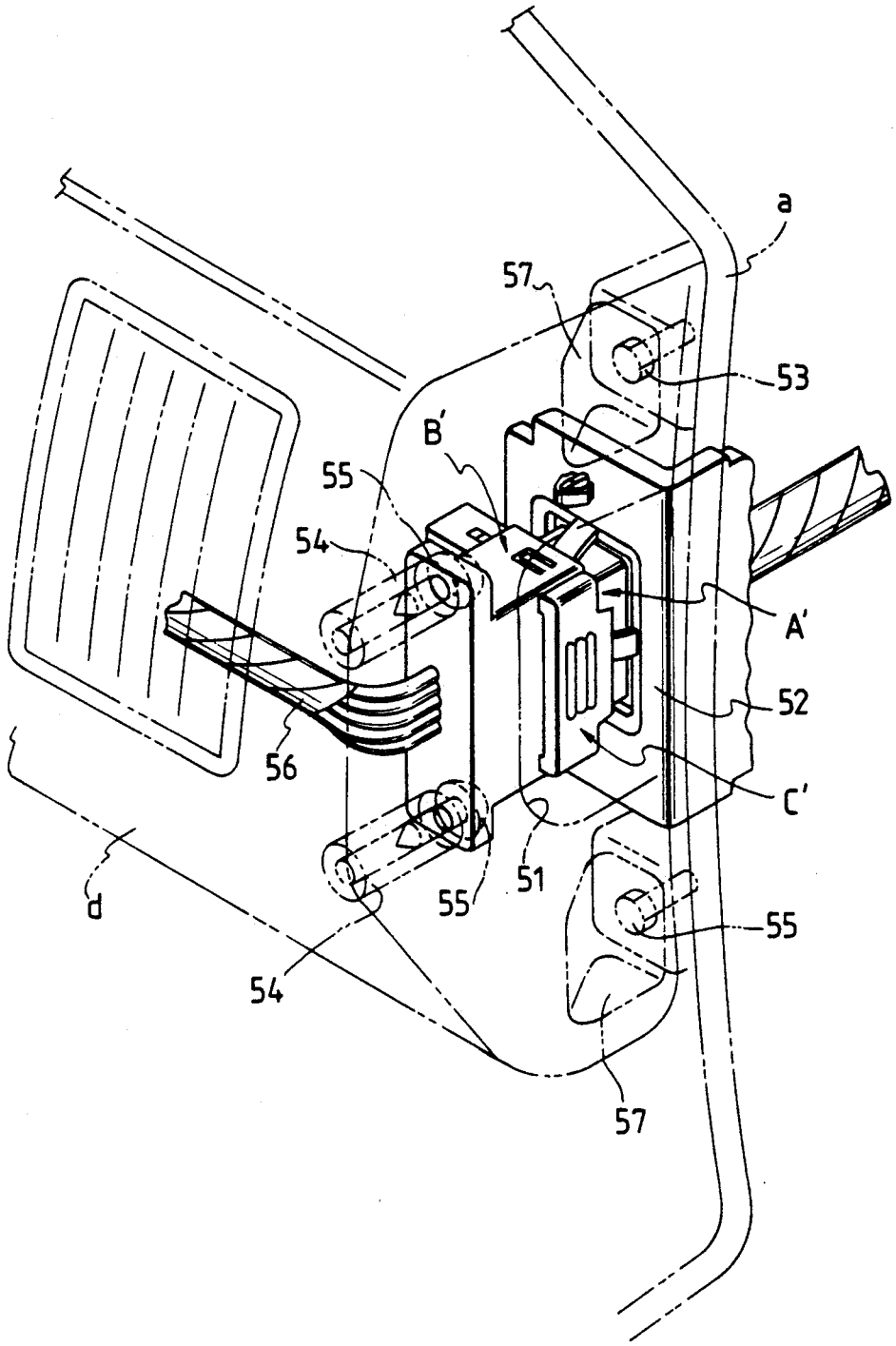
FIG. 11 is a perspective view showing an example in which the connecting device of the second embodiment is used.
Figure 12:
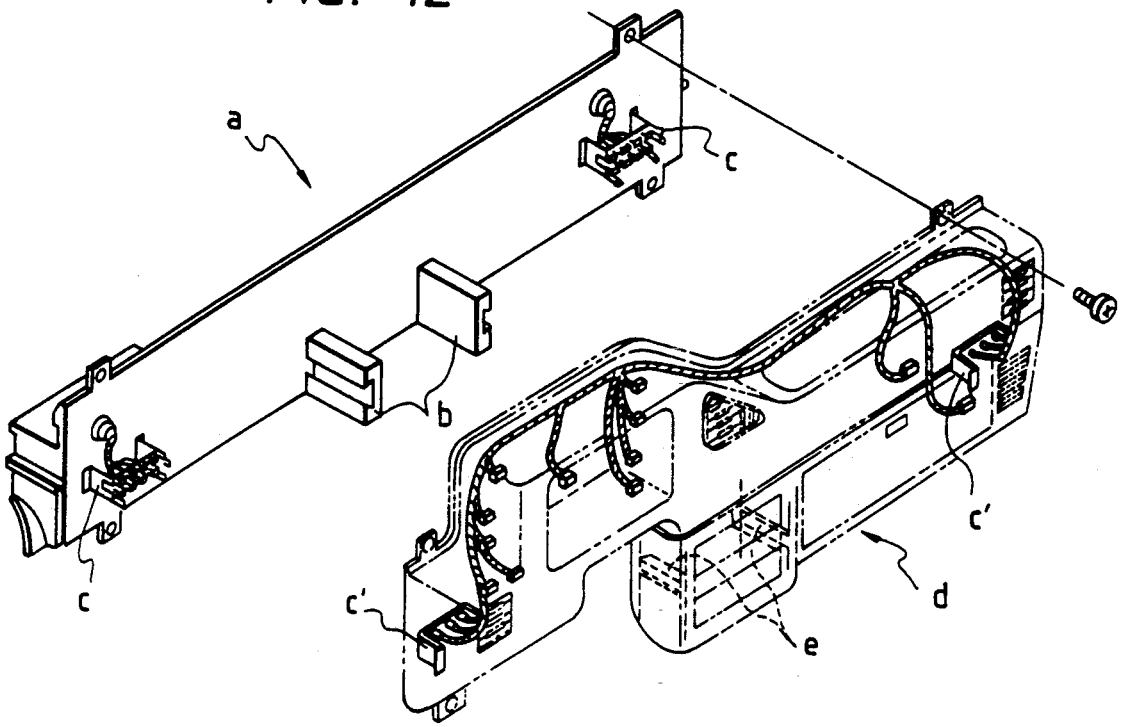
FIG. 12 is a perspective view of a conventional connecting device.
Figure 13:
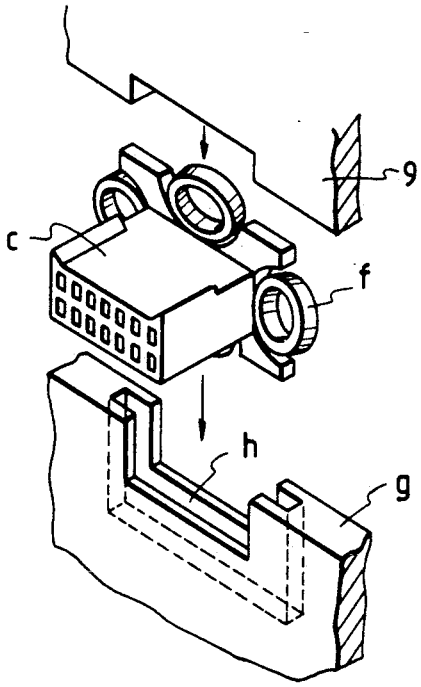
FIG. 13 is an enlarged perspective view showing a support construction for a dashboard-side connector of FIG. 12.

In the above condition, when the instrument panel d is fixedly secured to the dashboard a by bolts to finish the mounting operation as illustrated in FIG. 11, only the front end portion of the male connector A is received in the hood 18 of the female connector 18 (provisionally-fitted condition), as shown in FIG. 4(A). At this time, female and male terminals 16 and 21 are not yet in contact with each other. However, due to the provision of the chamfered surface 1*a* on the fitting side of the male connector A, the male connector A can be easily fitted in the hood 18. As described above, the male connector A is displaceable in the horizontal and vertical directions and therefore has a self-aligning capability. Accordingly, even if the female connector B is slightly misaligned with respect to the male connector A, this misalignment is compensated for by the self-aligning ability of the male connector. As a result, the male and female connectors A and B, when provisionally fitted together, are always maintained in a properly-aligned condition such that the axes of the mating female and male terminals 16 and 21 are aligned with each other. As shown in FIG. 5(A), the pin guide groove 22 of the female connector B and the cam groove 28 of the cam member C, which receive the cam pins 3 of the male connector A, have the wide introduction guide groove 22 and the wide open end 28*a*, respectively, so that the cam pin 3 will not fictionally damage these grooves 22 and 28.

Figure 4B:
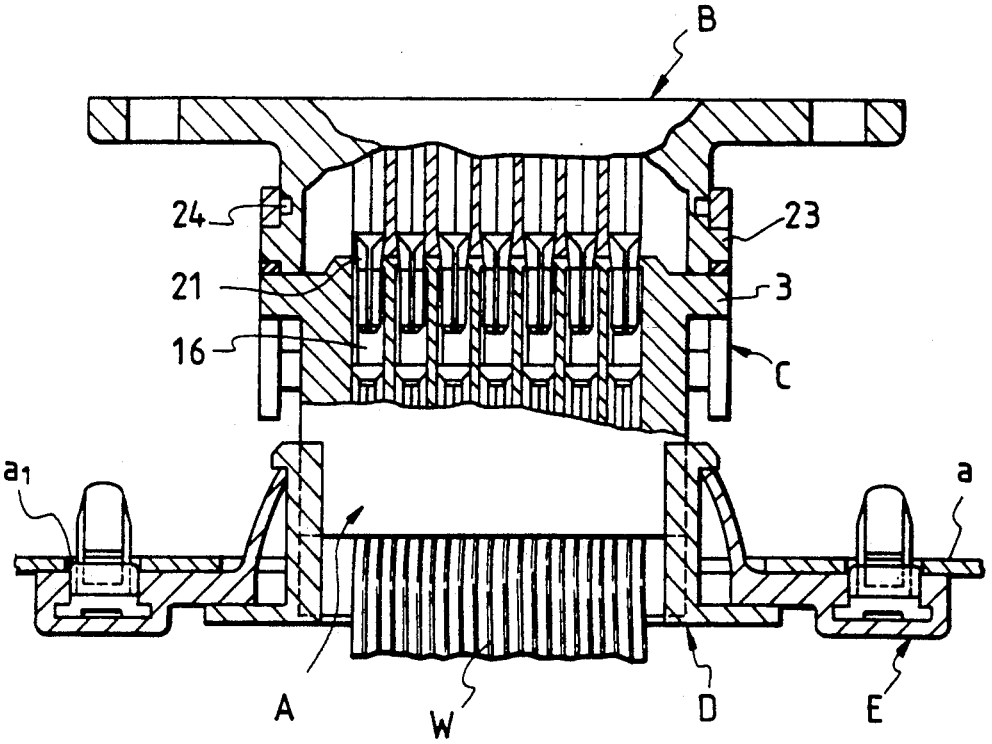
FIG. 4(B) is a cross-sectional view showing a completely-fitted condition of the connectors.
Figure 5B:
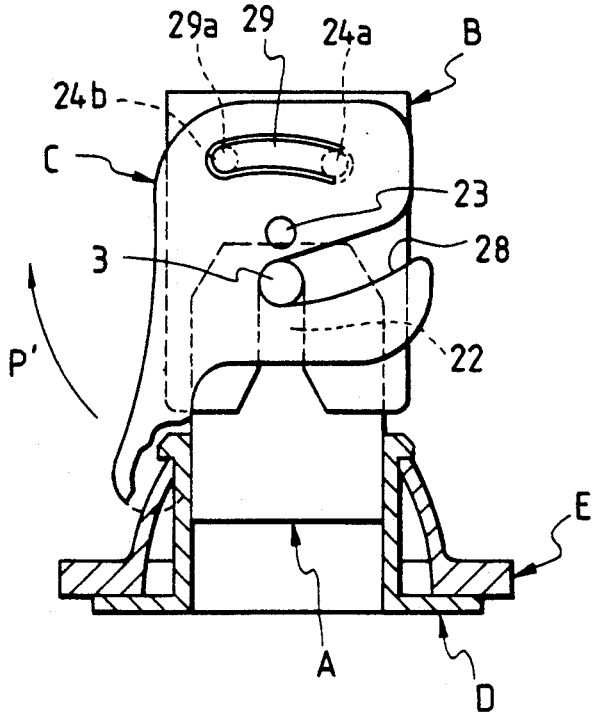

After the male and female connectors A and B have been provisionally fitted together, they are completely fitted together by angularly moving the cam member C in a direction of arrow P in FIG. 5(A). As a result, the male connector A is drawn toward the female connector B due to the engagement of the cam pin 3 with the cam groove 28, as indicated by arrow Q. FIGS. 4(B) and 5(B) show the completely-fitted condition of the two connectors, in which the front half portion of the male connector A is completely fitted in the hood 18, and their fitting surfaces are in contact with each other so that the male and female terminals 21 and 16 are completely engaged together. In this completely-fitted condition, since the retaining pawl 29*a* of the flexible retaining piece 29 of the lever 26 is engaged in the completely-retaining recess 24*b* in the retaining groove 24 of the female connector B, the cam member C is locked. Further, since the retaining pawl 9*a* of the flexible retaining arm 9 is engaged in the completely-retaining recess 5*b* in the slide groove 5 in the male connector A, the male connector A is also locked.

In the above example, although the male connector A is mounted on the dashboard and the female connector B is mounted on the instrument panel, they may be reversed. Further, it is noted that to move the male and female connectors A and B from the completely-fitted condition to the provisionally-fitted condition, the cam member C is rotated in the reverse direction, that is, in a direction of arrow P' in FIG. 5(B). According to the invention, the fitting between the male and female connectors A and B, and hence the fitting between female and male terminals 16 and 21, can be easily effected due to the leverage of the levers 26 through the cam pins 2, engaged in the respective cam grooves 28, with a force smaller than an originally-required insertion force. Therefore, even multi-pole type connectors can be easily fitted together.

FIGS. 6 to 10 show a second embodiment of the present invention in which the above-mentioned connector holder D is omitted; a male connector A' is supported directly by the bracket E; a housing body 33 and a hood 37 of a female connector B' are separate from each other; and the housing body 33 is movable back and forth. In these Figures, female terminals 16 are received respectively in terminal receiving chambers 2 in a housing 1' of the male connector A' as described above for the first embodiment. Further, return prevention ribs 31 are formed respectively on outer walls of the housing 1', and a withdrawal prevention flange 32 is formed on the outer periphery of the rear end of the housing. As shown in FIGS. 9(A) and 10(A), when the male connector A' is inserted into the fitting hole 12 of the bracket E, the withdrawal prevention flange 32 abuts against the plate-like body 11, and the distal ends of the resilient support pieces 13 engage the return prevention ribs 31, respectively. Therefore, the male connector A', like the above-mentioned connector holder d, is support so as to be displaceable in both the horizontal and vertical directions relative to the bracket E.

The female connector B' comprises the housing body 33, and the hood 37 for receiving the male connector A', which hood is separate from the housing body 33. The housing body 33 is slidable relative to the hood 37, and the connection between the housing body 3 and the male connector A' is effected by operating a cam member C'.

Figure 8:
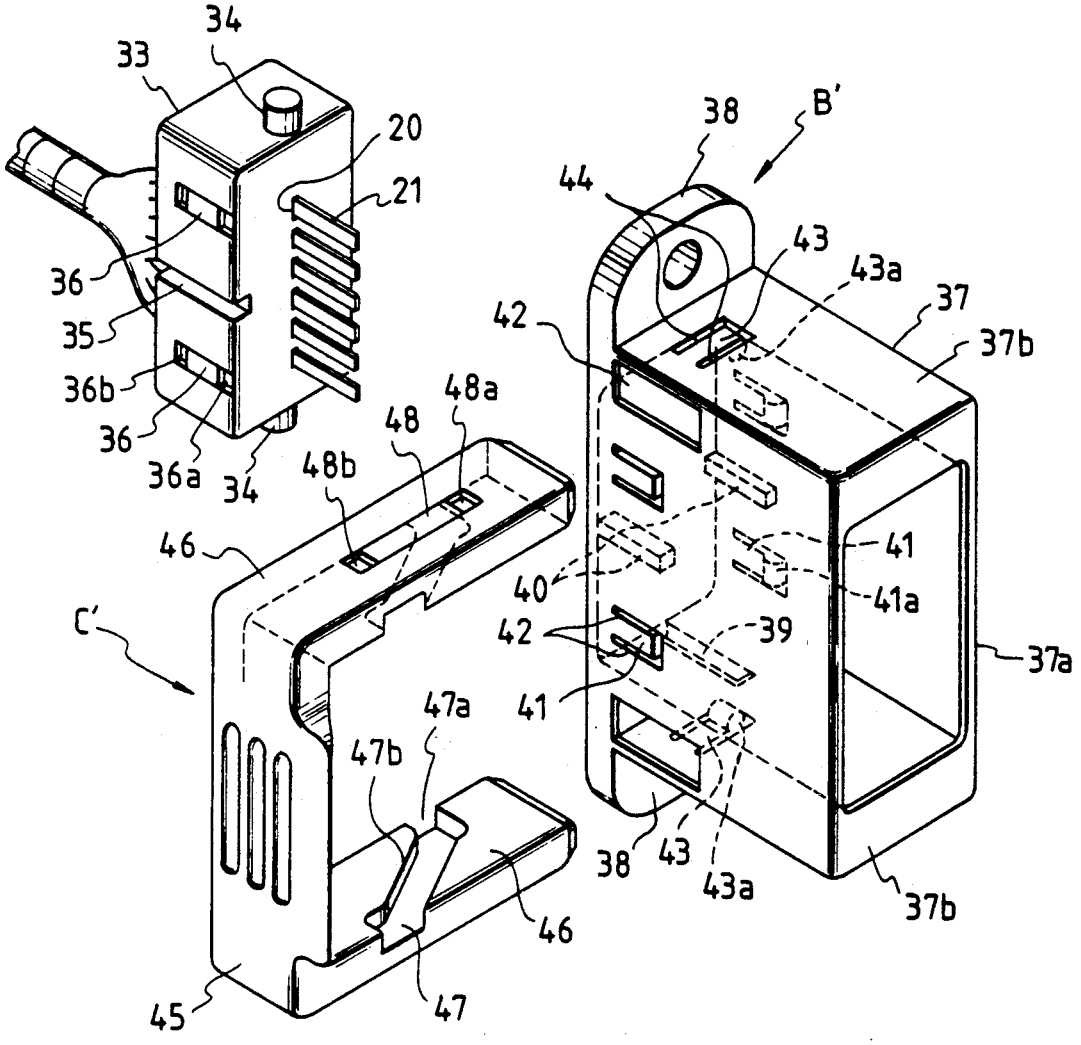
FIG. 8 is an exploded perspective view of the female connector of FIG. 6.

As shown in FIG. 8, male terminals 21 are respectively retained in terminal receiving chambers 21 of the housing body 33. Cam pins 34 are formed respectively on the front of upper and lower walls of the housing body 33. Additionally, guide grooves 35 for guiding the hood 37 are formed respectively on central portions of the side walls of the housing body 33. Further, two (upper and lower) slide grooves 36 are formed in each of the side walls. A provisionally-retaining recess 36*a* is formed at a front end of the slide groove 36, while a completely-retaining recess 36*b* is formed at the rear end of the slide groove 36. The hood 37, like the above-mentioned hood 18, comprises a frame having right and left side walls 37*a* and upper and lower walls 37*b* thicker than the side walls 37*a*, and a mounting flange 38 at its rear end. Pin guide grooves 39, for respectively guiding the cam pins 34 of the housing body 33, are respectively formed in the inner surfaces of the upper and lower walls 37*b* at the rear of the hood 37 extending in the connector fitting direction. An elongate guide projection 40 for fitting in the guide groove 35 in the housing body 33, as well as flexible retaining arms 41 for engagement with the slide grooves 36, is formed on each of the right and left side walls 37*a*. The flexible retaining arm 41 is bendable relative to the hood 37 due to two slits 42 adjacent thereto, and includes a retaining pawl 41*a* at its free end. Arm insertion through holes 42 for receiving a pair of arms 46 and 46 of the cam member C' are formed in the upper and lower walls 37*b* of the hood 37. The arm insertion holes 42 extend perpendicularly to the connector fitting direction, that is, across the pin guide groove 39. A flexible retaining piece 43 is formed on the wall 37*b* and is movable into and out of the arm insertion hole 42 due to two slits 44. The retaining piece has a retaining pawl 43*a* formed on the inner surface of the free end thereof.

The cam member C' is U-shaped including an operating plate 45 and arms 46 which extend perpendicularly from the opposite ends of the operating plate 45, respectively. A cam groove 47, for engagement with the cam pin 34, is formed in the inner surface of the arm 46, and a retaining groove 48, for engagement with the flexible retaining piece 43, is formed in the outer surface of the arm 46. The cam groove 47 includes a wide introduction guide groove 47*a* and an oblique groove 47*b* forwardly extending obliquely from the groove 47*a*. The retaining groove 48 has a provisionally-retaining recess 48*a* at its front end, and a completely-retaining recess 48*b* at its rear end.

Figure 9A:
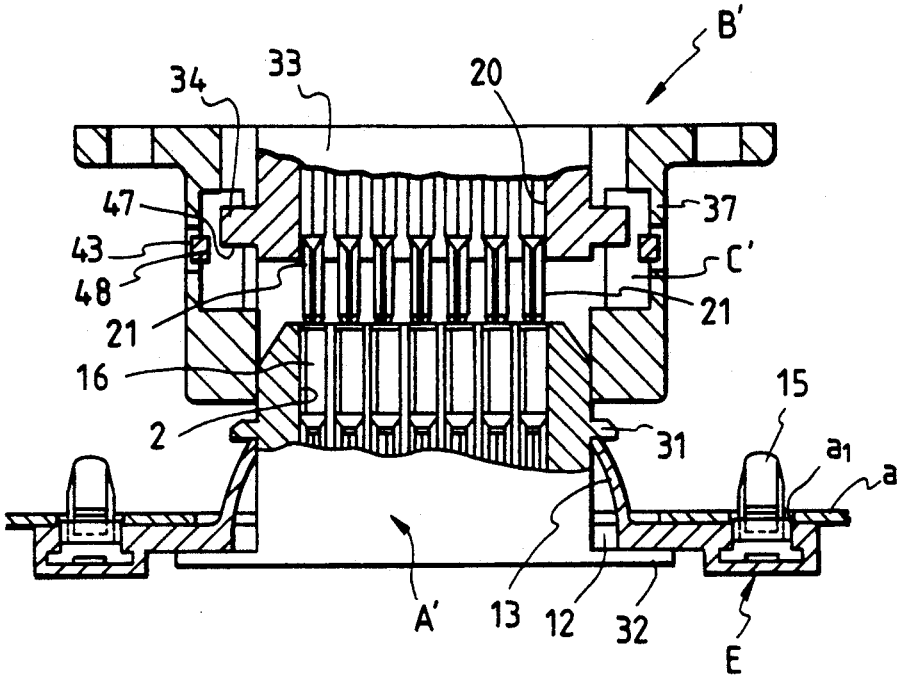
FIG. 9(A) is a cross-sectional view showing a provisionally-fitted condition of the female and male connectors of FIG. 6.
Figure 10A:
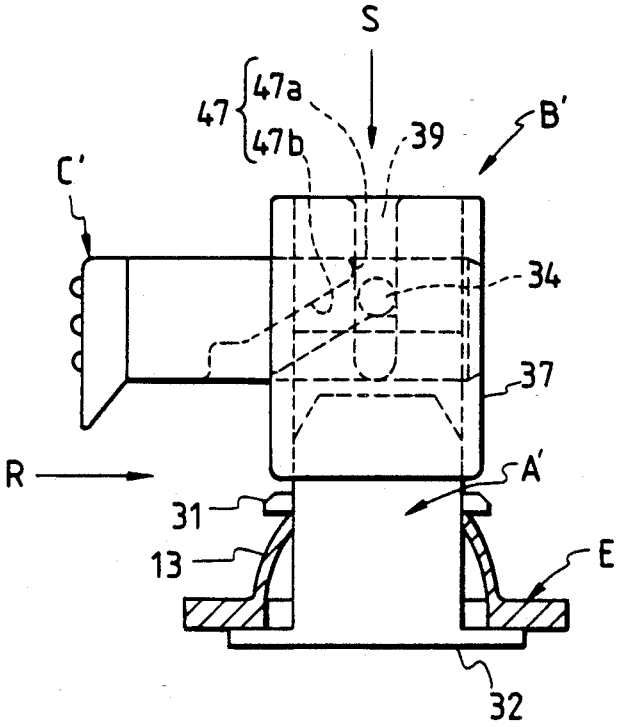
FIGS. 10(A) and 10(B) are partial cross-sectional, side-elevational views showing the connector arrangement of FIGS. 9(A) and 9(B), respectively.

In the above second embodiment, as shown in FIGS. 9(A) and 10(A), the male connector A' is beforehand mounted on a dashboard a via bracket E so as to be resiliently displaceable as described above. On the other hand, with respect to the female connector B', the housing body 33 is inserted into the rear half portion of the hood 37, with the guide projections 40 fitted in the respective guide grooves 35. The retaining pawl 41*a* of the flexible retaining arm 41 is engaged in the provisionally-retaining recess 36*a* of the slide groove 36 to achieve a provisionally-retained condition. Also, the arm 46 of the cam member C' is inserted into the arm insertion hole 42, and the retaining pawl 43*a* of the flexible retaining piece 43 is engaged in the provisionally-retaining recess 48*a* of the retaining groove 48 to achieve a provisionally-retained condition. In this condition, as described above for the first embodiment, the female connector B' is fixedly secured to an instrument panel by screws passing through the mounting flange 38. In the condition in which the housing body 33 and the cam member C' are provisionally retained on the hood 37, the cam pin 34 is disposed at an intermediate portion of the cam guide groove 39 and in the introduction guide groove 47*a* of the cam groove 47.

In the above condition, as described above for the first embodiment, when the instrument panel d is mounted on the dashboard the front half portion of the male connector A' is fitted in the hood 37 (provisionally-fitted condition). Further, as in the first embodiment, the female and male terminals 16 and 21 are not yet contacted with each other. Due to the self-aligning function of the bracket E, the male connector A is aligned with the housing body 33 of the female connector B' within the hood 37.

Figure 9B:
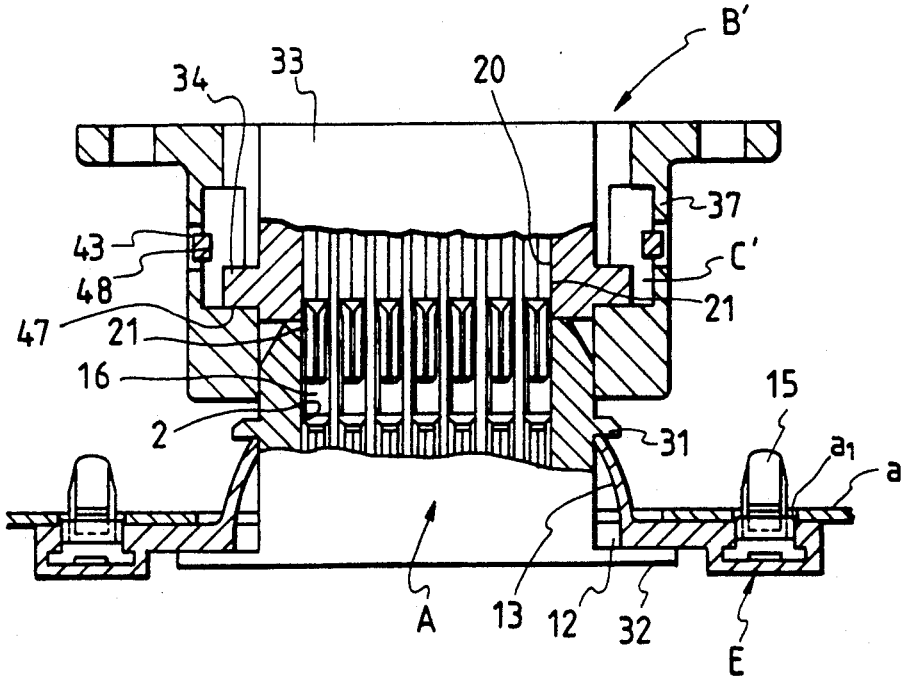
FIG. 9(B) is a cross-sectional view showing a completely-fitted condition.
Figure 10B:
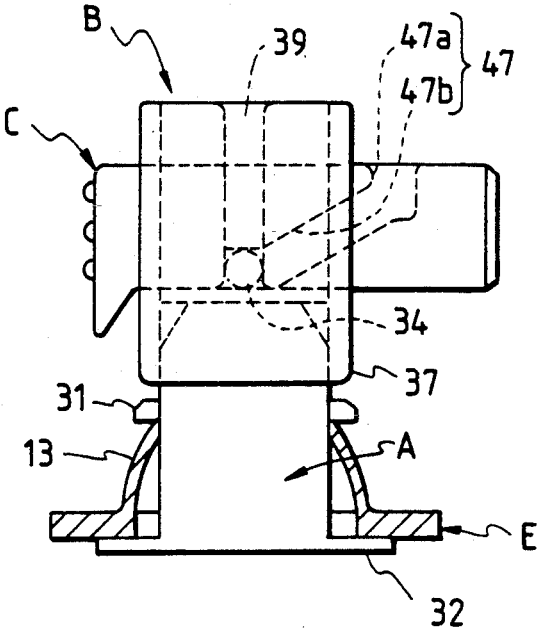

Thereafter, the male and female connectors A' and B' are completely fitted together by operating the cam member C' after the above provisionally-fitting. When the cam member C' is pushed in a direction of arrow R in FIG. 10(A), the housing body 33 of the female connector B' is drawn toward the male connector A', as indicated by arrow S, due to the engagement of the cam pins in the oblique grooves 47*b* of the cam grooves 47. FIGS. 9(B) and 10(B) show the completely-fitted condition of the two connectors, in which the housing body 33 of the female connector B' is completely received in the hood 37, their fitting surfaces are in contact with each other, and the male terminals 21 are completely engaged with the female terminals 16, respectively. In this completely-fitted condition, since the retaining pawl 43*a* of the flexible retaining piece 43 of the hood 37 is engaged in the completely-retaining recess 48*b* of the retaining groove 48 of the cam member C', the cam member C' is locked. Similarly, the retaining pawl 41*a* of the flexible retaining arm 41 is also engaged in groove 36 of the housing body 33 so that the housing body 33 is also locked.

Figure 6:
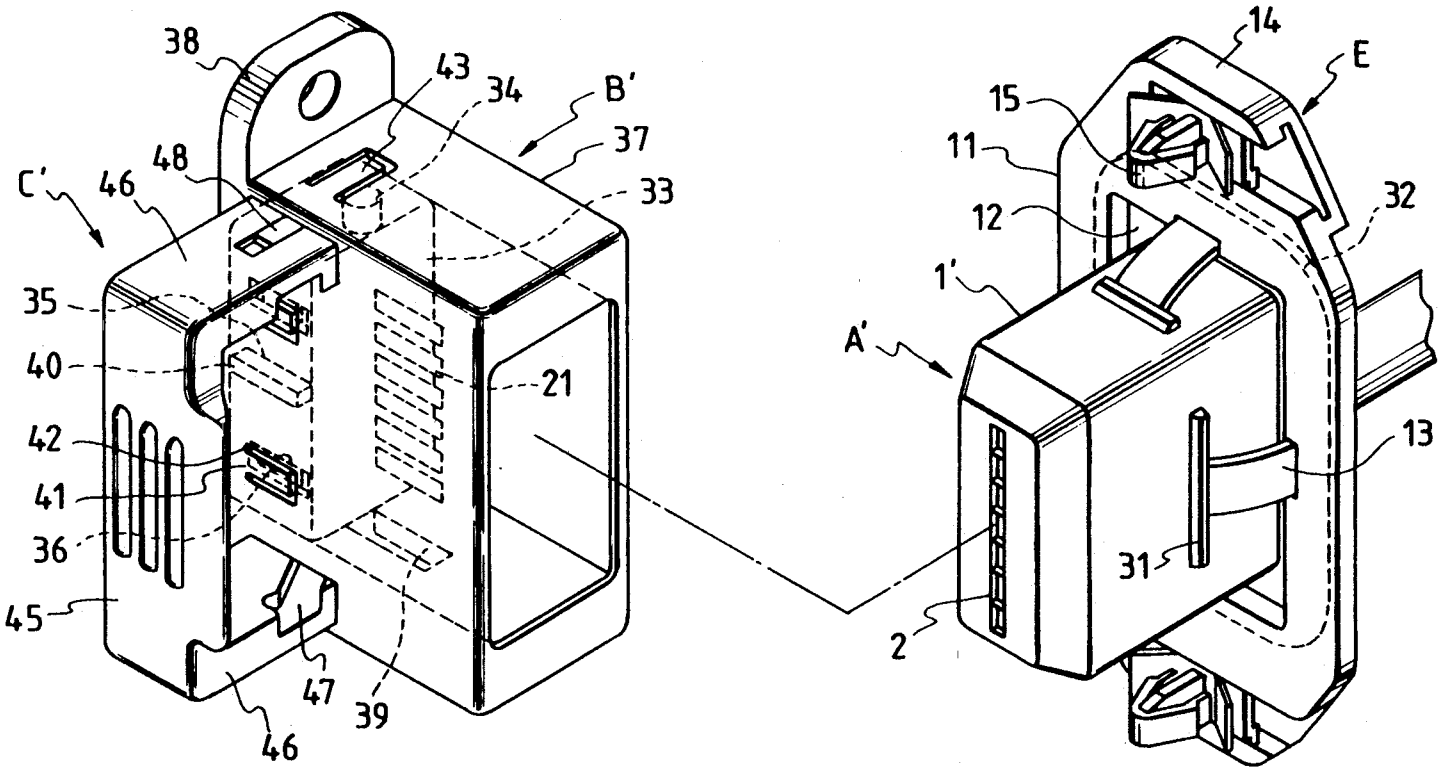
FIG. 6 is a perspective view of a second embodiment of a device of the present invention, showing female and male connectors in their separated condition.
Figure 7:
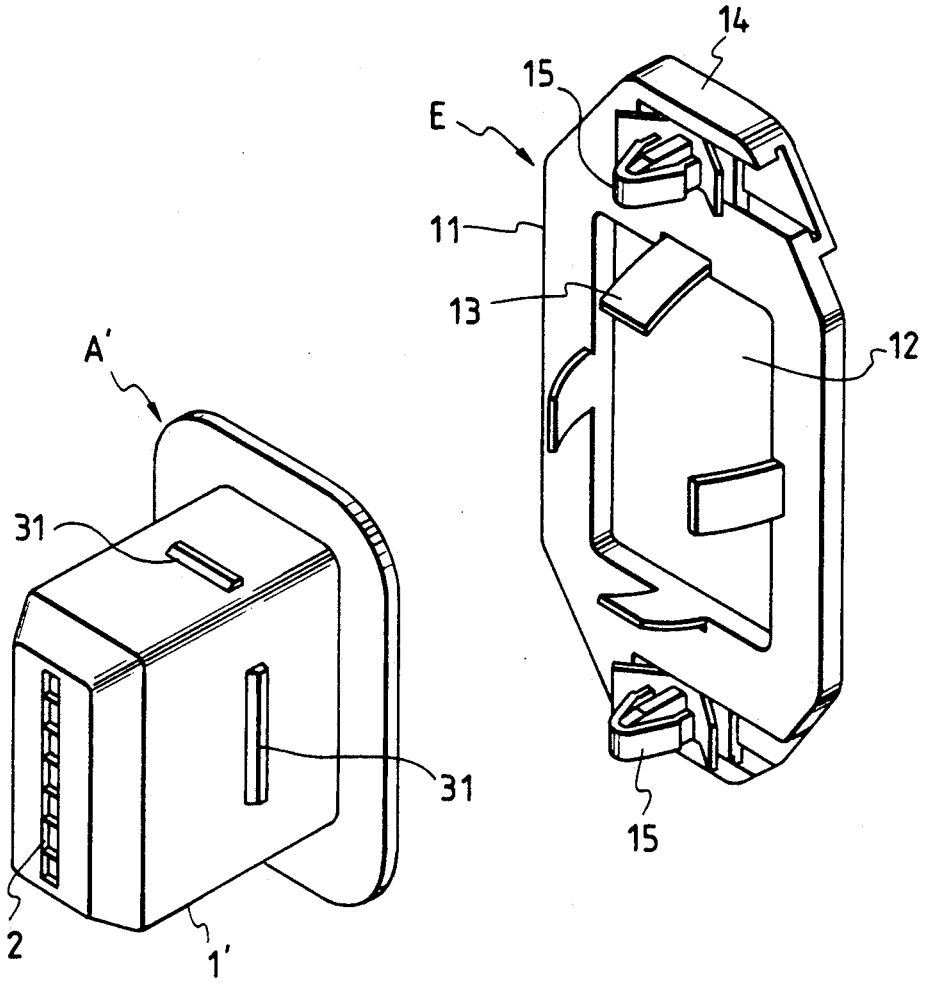
FIG. 7 is an exploded perspective view of the male connector of FIG. 6.

FIG. 11 shows the condition in which the male connector A' and the female connector B' are completely fitted together as a result of attachment of the instrument panel d to the dashboard The instrument panel d has an operation window 51 at a central portion of a side wall, and a lid 52 for covering this window. Additionally, the side wall has upper and lower recesses 57. The instrument panel d is fixedly secured to the dashboard d by bolts 53 received respectively in the recesses 57 and extending into the dashboard. The mounting flange 38 of the hood 37 of the female connector B' is fixedly secured by screws 55 to support portions 54 within the instrument panel. When the instrument panel d is to be fixedly secured to the dashboard a in the above-mentioned manner, the cam member C' is provisionally retained on the hood 37 in such a manner that a portion of the cam member projects from the hood 37, as shown in FIGS. 10(A) and 6. Therefore, the operator can simply push the cam member C' into the hood, utilizing the operation window 51, so that the housing body 33, connected to an end of a wire harness 56, is completely fitted relative to the male connector A'.

As described above, in the present invention, one of the female and male connectors is set on the mounting member whereas the other is set on the attachment member, and the two connectors are connected together simultaneously when the two members are assembled together. The two connectors are once held in the provisionally-fitted condition in which the female and male terminals are not in contact with each other, and after the two connectors are aligned with each other by absorbing a dimensional error in the connection between the two connectors, the two connectors are completely fitted together. Therefore, the connector terminals and housings are not damaged, and an electrical connection which is highly reliable can be achieved.

What is claimed is:

1. A connecting device for connecting a female connector, secured to a first panel, to a male connector, secured to a second panel, said connectors having respective contacts for electrically connecting said connectors together, said device comprising:

retaining means for retaining said male and female connectors together in a provisionally-fitted condition in which the respective terminals of said male and female connectors do not contact one another, and for allowing said first and second panels to be mounted ton one another when said connectors are retained in said provisionally-fitted condition; and moving means for moving one of said connectors in an insertion direction from said provisionally-fitted condition to a completely-fitted condition in which the respective terminals of said connectors contact one another.

2. The device of claim 1, wherein said retaining means includes means for allowing said male and female connectors to move relative to one another in a direction transverse to said insertion direction in order to facilitate alignment thereof.

3. The device of claim 1, wherein said first panel is one of an instrument panel and a dashboard and said second panel is another one of said instrument and said dashboard.

4. The device of claim 1, wherein said retaining means comprises a bracket secured to one of said first and second panels and a holder secured to said bracket, said one connector being slidably disposed in said holder so as to be moveable from a first position corresponding to said provisionally-fitted condition to a second position corresponding to said completely-fitted condition.

5. The device of claim 4, wherein said holder includes means for securing said one connector in said first and second positions.

6. The device of claim 4, wherein said holder includes a flange which abuts against said bracket to prevent said holder from moving in a direction associated with disconnecting said connectors from each other.

7. The device of claim 1, wherein said moving means comprises a cam member pivotally secured to the other connector and including a cam groove slidably engageable with said one connector, wherein said one connector is moved from said provisionally-fitted condition to said completely-fitted condition by pivoting said cam member.

8. The device of claim 7, further comprising means for fixing said cam member in a first position corresponding to said provisionally-fitted condition and a second position corresponding to said completely-fitted condition.

9. A connecting device for connecting a female connector, secured to a first member, to a male connector, secured to a second member, said connectors having respective contacts for electrically connecting said connectors together, said device comprising:

retaining means for retaining said male and female connectors together in a provisionally-fitted condition in which the respective terminals of said male and female connectors do not contact now another, and for allowing said first and second members to be mounted to one another when said connectors are retained in said provisionally-fitted condition;

moving means for moving one of said connectors in an insertion direction from said provisionally-fitted condition to a completely-fitted condition in which the respective terminals of said connectors contact one another, said moving means including a cam member pivotally secured to the other connector and including a cam groove slidably engageable with said one connector, wherein said one connector is moved from said provisionally-fitted condition to said completely-fitted condition by pivoting said cam member; and means for fixing said cam member in a first position corresponding to said provisionally-fitted condition and a second position corresponding to said completely-fitted condition, wherein said fixing means comprises a flexible pawl protruding from said cam member which is engageable with first and second recesses in said one connector respectively corresponding to said provisionally-fitted condition and said completely-fitted condition.

10. The device of claim 1, wherein said one connector includes a connector housing and a hood having an opening for slidably receiving said connector housing therein.

11. The device of claim 10, wherein said moving means comprises a cam member slidably disposed in said hood in a transverse direction with respect to an insertion direction of said connectors.

12. The device of claim 11, wherein said cam member is U-shaped including a pair of legs, each of said legs having a cam groove respectively engageable with pins protruding from said connector housing, said connector housing being moved in said insertion direction when said cam member is moved in said transverse direction.

13. The device of claim 12, further comprising means for retaining said cam member and said connector housing in a first position corresponding to said provisionally-fitted condition and a second position corresponding to said completely-fitted condition.

14. A device of claim 1, wherein said retaining means comprises a first bracket for securing the other of said connectors to a corresponding one of said panels and a second bracket which is integral with said one connector for securing said one connector to the corresponding other panel.

15. The device of claim 14, wherein the other connector includes a flange which abuts against said first bracket to prevent said holder from moving in a direction associated with disconnecting said connectors from each other.

* * * * *